US007315320B2

(12) United States Patent
Ohkubo

(10) Patent No.: US 7,315,320 B2
(45) Date of Patent: Jan. 1, 2008

(54) OPTICAL WRITING SYSTEM AND METHOD, AND IMAGE FORMING APPARATUS RECEIVING AN EXTERNAL PARAMETER

(75) Inventor: Hiroki Ohkubo, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 354 days.

(21) Appl. No.: 10/774,367

(22) Filed: Feb. 10, 2004

(65) Prior Publication Data

US 2004/0155953 A1 Aug. 12, 2004

(30) Foreign Application Priority Data

Feb. 10, 2003 (JP) ..... 2003-032588

(51) Int. Cl.
*B41J 2/45* (2006.01)
*B41J 2/455* (2006.01)

(52) U.S. Cl. ..... 347/238; 347/233

(58) Field of Classification Search ..... 347/249, 347/250, 235, 233, 234, 232; 400/118.2; 399/83; 345/771; 382/167
See application file for complete search history.

(56) References Cited

U.S. PATENT DOCUMENTS 5,565,964 A * 10/1996 Tashiro et al. ..... 399/83
6,281,922 B1 * 8/2001 Suzuki ..... 347/235
6,559,976 B1 * 5/2003 Hirota ..... 358/3.03
6,807,320 B1 * 10/2004 Sawada ..... 382/289
2001/0028387 A1 * 10/2001 Maeda ..... 347/232
2002/0063770 A1 * 5/2002 Takesue ..... 347/234
2002/0126152 A1 * 9/2002 Morikawa ..... 345/771
2002/0149666 A1 * 10/2002 Amada et al. ..... 347/233
2003/0025782 A1 * 2/2003 Amada et al. ..... 347/233
2003/0025785 A1 * 2/2003 Nihei et al. ..... 347/250
2003/0112475 A1 * 6/2003 Shoda et al. ..... 358/474
2003/0142865 A1 * 7/2003 Hirota et al. ..... 382/167
2004/0184859 A1 * 9/2004 Shimmura ..... 400/118.2
2005/0041261 A1 * 2/2005 Narushima et al. ..... 358/1.9

FOREIGN PATENT DOCUMENTS

JP 10226104 8/1998
JP 2001091870 A * 4/2001

* cited by examiner

*Primary Examiner*—Hai Pham
*Assistant Examiner*—Carlos A. Martinez, Jr.
(74) *Attorney, Agent, or Firm*—Oblon, Spivak, McClelland, Maier & Neustadt, P.C.

(57) ABSTRACT

An optical writing system with at least two laser diodes capable of correcting hue deviations. The optical writing system is capable of correcting dot forming positions in the main scanning direction, and setting values for correction through an external key operation unit stored in a phase shift amount register by way of a CPU included in a main controller, and by applying values for arbitrarily shifting picture element clock phases for respective laser diodes. Thus, frequency fluctuations and characteristic changes in the laser diodes over time are compensated, positional precision with respect to a synchronization point is assured for respective laser diodes, picture images at the terminating edge in the main scanning direction is stabilized, and subtle hue variations can be reduced in half tone image portions during repeated full color image formations.

11 Claims, 14 Drawing Sheets

| |
|---|
| FIG. 12A |
| FIG. 12B |

OPTICAL WRITING SYSTEM AND METHOD, AND IMAGE FORMING APPARATUS RECEIVING AN EXTERNAL PARAMETER

BACKGROUND

1. Field

This patent specification relates to an optical writing system provided with at least two laser diodes capable of properly correcting hue deviations. Also, image forming apparatuses incorporating the optical writing system, inclusive of color laser printers, full color digital duplication apparatuses, and digital multiplex machines. Also, a method of correcting the hues implemented through computation processing.

2. Discussion of the Background

Techniques related to the correction of output images for optical writing system have been disclosed in Japanese Laid-Open Patent Application No. 10-226104, in which a printer capable of processing images with high quality at high speed is formed by using video clock signals delayed by a delay circuit having the phase matched to a horizontal start signal.

In the printer, there are provided a plurality of delay elements for delaying an original video clock signal and a selection circuit for selecting video signals having a phase in agreement with the horizontal start signal out of the delayed signals.

In general, an image forming apparatus such as, for example, a digital color image forming machine consists of several units in addition to photoreceptor belt, including a pre-exposure unit (discharging unit), primary charging unit equipped with a grid, light exposure unit for imaging equipped with an LD as a light source, surface electrometer for measuring surface potential of the photoreceptor belt, developing unit, transfer charger, separation charger, cleaning, etc.

On the other hand, the aforementioned application No. 10-226104 discloses, since video clock signals delayed by the delay circuit having the phase matched to a horizontal start signal are selected out of original video clock signals in a video clock synchronization circuit or video clock signals delayed by the delay circuit with the plurality of delay elements, it becomes feasible to generate video clock signals phase matched to a horizontal start signal and to handle high speed outputting of images.

Although the phase matching is feasible by the above-mentioned techniques between video clock signals (which are hereinafter referred to as image clock signals) and horizontal synchronization signals, numerous similar methods are already present for controlling the phase of video clock signals.

Although image correction of the dot forming position for the terminating edge in the main scanning direction may be feasible to a certain extent by utilizing the difference in image magnification for respective LDs according to the noted techniques, problems exist regarding (1) eliminating the effects on images of the difference caused by a large power output difference between two LDs and beam pitch deviation and (2) acquiring stable image qualities.

Furthermore, when phase control is intended for image clock signals to be adjusted arbitrarily to compensate the frequency change caused in the LD by deterioration over time, the noted techniques provide inadequate control.

Accordingly, what needed is a method of precise phase control for image clock signals.

It is desirable that the method is capable of properly shifting the phase of image clock signals to compensate for the deterioration of LD over time and the variation of LD characteristics caused by frequency fluctuation, so that positional precision from a synchronization point for respective LDs is assured and picture images at the terminating edge in the main scanning direction can be stabilized.

It is further desirable that the method is capable of eliminating difficulties in generating proper hues from dot positioning precision which is common to full color image formation using two or more LD light sources.

Moreover, it is also desirable that the method attain both the stabilization of picture images at a terminating edge in a main scanning direction and the elimination of deficiencies in generating proper hues from dot positioning precision, simultaneously.

Further, it is desirable that control of image quality be controllable at user's own discretion on full color images which may be formed in a variety of qualities and resulting from a difference in wavelength, a power output of respective LDs, and in the beam pitch between the LDs, so that the user selection can properly be made regarding hue variations in half tone image portions formed with dither patterns, whereby excellent image qualities can maintained.

SUMMARY

Accordingly, it is an object of the present disclosure to provide an optical writing system provided with at least two laser diodes, a method therefore, and image forming apparatuses incorporating the optical writing system, having most, if not all, of the advantages and features of similar employed methods and systems, while eliminating many of the aforementioned disadvantages.

To achieve the foregoing and other objects, an optical writing system disclosed herein includes at least two laser diodes;

a polygonal mirror;

first correction means for scanning data of the two laser diodes by one scanning movement with the polygonal mirror, and correcting a dot forming position for a terminating edge in the main scanning direction by shifting arbitrarily the phase of picture element clocks; and second correction means for correcting the amount of deviation in data writing position along the vertical scanning direction to be at least approximately one laser diode line width, in which first means is provided for calling up from the exterior to subsequently operate the first correction means.

In addition, the optical writing system may further include second means for calling up from the exterior to subsequently operate the second correction means.

According to an alternate embodiment, a method of correcting data written by an optical writing system is disclosed, including the steps of providing at least two laser diodes;

providing a polygonal mirror;

scanning data of two laser diodes by one scanning movement with the polygonal mirror;

performing a first correction means for correcting a dot forming position for the terminating edge in the main scanning direction by shifting arbitrarily the phase of picture element clocks; and performing a second correction means for correcting the amount of deviation in data writing position along the vertical scanning direction to be approximately one line width, wherein, if an image to be formed is decided not to be in mono-color through a decision whether the image to be formed is in mono-color, the second correction means is set from the exterior to subsequently be implemented;

after implementing the second correction means, the first correction means is set from the exterior to subsequently be implemented; and, after having implemented the second and first correction means, an image formation is carried out.

The setting of the second correction capability in the method can be carried out from the exterior depending on the kind of a document original selected from the group consisting of character, photography, and a mixture of character and photography, such that, if the document original contains characters, the second correction mechanism is enabled under a setting of relative ease for correcting the amount of deviation in data writing position, and so on as will be detailed later on.

In another embodiment, an image forming apparatus is disclosed herein, including the above mentioned optical writing system and an image forming mechanism configured to form visible images on a sheet by rendering visible electrostatic latent images written by the optical writing system.

In yet another embodiment, also disclosed herein are a computer program product for use with an optical writing system, and a program storage device readable by a machine, tangibly embodying a program of instructions executable by the machine to perform the method of correcting data written by the optical writing system.

The present disclosure and features and advantages thereof will be more readily apparent from the following detailed description and appended claims when taken with drawings.

BRIEF DESCRIPTION OF THE DRAWINGS

In the following drawings, like references numerals will be used to refer to like elements in the various drawings, in which.

DESCRIPTION OF THE PREFERRED EMBODIMENTS

Figure 1:
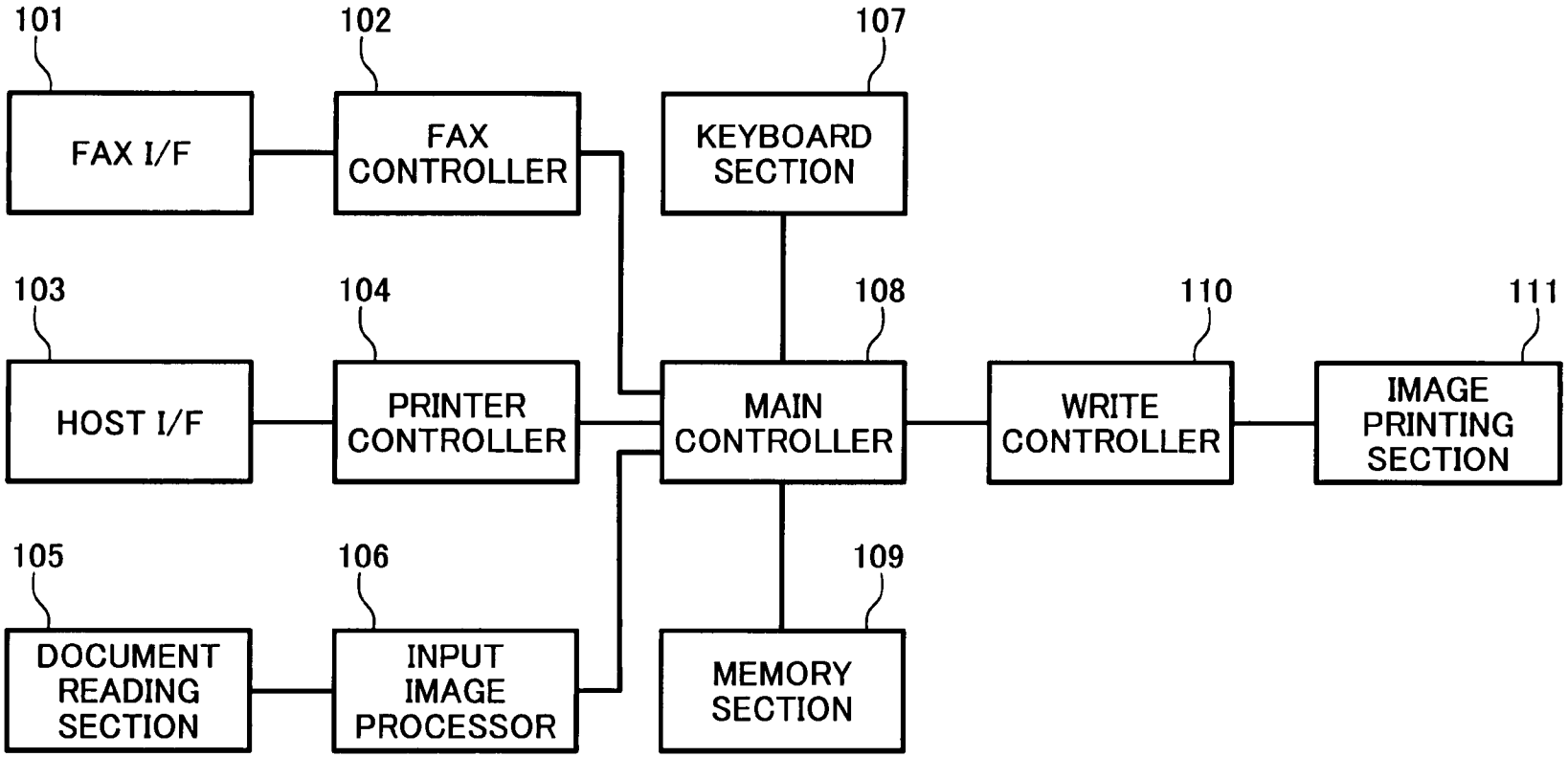
FIG. 1 is a diagrammatic block diagram illustrating the overall functional construction of a control system included in an image forming apparatus as a digital full color duplication apparatus disclosed herein.

In the detailed description which follows, specific embodiments of an optical writing system provided with at least two laser diodes and image forming apparatuses incorporating the optical writing system are described, which are particularly useful for optical systems provided with two or more laser diodes.

It is understood, however, that the present disclosure is not limited to these embodiments. For example, it is appreciated that the capability for properly correcting hue deviations may also be adaptable to any form of color image data correction. Other embodiments will be apparent to those skilled in the art upon reading the following description.

An optical writing system disclosed herein includes at least two laser diodes; a polygonal mirror; first correction means for scanning data of two laser diodes by one scanning movement with the polygonal mirror, and correcting a dot forming position for a terminating edge in the main scanning direction by shifting arbitrarily the phase of picture element clocks; and second correction means for correcting the amount of deviation in data writing position along the vertical scanning direction to be at least approximately one laser diode line width, in which first means is provided for calling up from the exterior to subsequently operate the first correction means.

The optical writing system may further include second means for calling up from the exterior to subsequently operate the second correction means.

In addition, the second means is also configured to be capable of lifting the operation by the second correction means from the exterior, and being operated in parallel to the first correction means.

Furthermore, the noted operation of shifting arbitrarily the phase of picture element clocks by the first correction means is carried out based on scaling error factors of the two laser diodes, which are selectively input through an external input operation means.

In another aspect, an optical writing system disclosed herein includes at least two laser diodes; a polygonal mirror; first correction means for scanning data of two laser diodes by one scanning movement with the polygonal mirror, and correcting a dot forming position for a terminating edge in the main scanning direction by shifting arbitrarily the phase of picture element clocks; and second correction means for correcting the amount of deviation in data writing position along the vertical scanning direction to be at least approximately one laser diode line width, in which second means is provided for calling up from the exterior to subsequently operate the second correction means.

In addition, the second means is also configured to be capable of lifting from the exterior the operation by the second correction means.

Furthermore, the second correction means is set from the exterior depending on the kind of a document original, which is selected from the group consisting of character, photography, and a mixture of character and photography, such that if the document original is with character, the second correction means is enabled under the setting of relative ease for correcting the amount of deviation in data writing position; if the document original is with photography, the second correction means operates to carry out one of being disabled, and being enabled under another setting of relative ease for correcting the amount of deviation in data writing position; if the document original is with mixture of character and photography, the second correction means operates to carry out one of being disabled, and being enabled under another setting of relative difficulty for correcting the amount of deviation in data writing position; and if the document original is with other than character, photography, and a mixture of character and photography, the second correction means operates to carry out one of being disabled, and being enabled under another setting of relative difficulty for correcting the amount of deviation in data writing position.

In yet another aspect, an image forming apparatus is disclosed including the above mentioned optical writing system and an image forming mechanism configured to form visible images on a sheet by rendering into visible electrostatic latent images written by the optical writing system into visible.

The image forming apparatus may be provided further with an operation input mechanism configured to selectively input an operation desirable to the image forming apparatus, so as to be capable of calling up the first correction means and the second correction means from the exterior to subsequently be operated individually or in combination.

In another aspect, a method of correcting data written by an optical writing system is provided, including the steps of providing at least two laser diodes; providing a polygonal mirror; scanning data of two laser diodes by one scanning movement with the polygonal mirror; correcting a dot forming position for the terminating edge in the main scanning direction by shifting arbitrarily the phase of picture element clocks; and correcting the amount of deviation in data writing position along the vertical scanning direction to be approximately one line width.

In this method of correcting data written by the optical writing system, if an image to be formed is decided not to be in mono-color through the decision whether the image to be formed is in mono-color, the step of correcting a dot forming position is set from the exterior to subsequently be implemented; after implementing the step of correcting the amount of deviation, the step of correcting a dot forming position is set from the exterior to subsequently be implemented; and, after having implemented the step of correcting the amount of deviation and the step of correcting a dot forming position, an image formation is carried out.

In addition, the setting of the step of correcting the amount of deviation is carried out depending on the kind of a document original selected from the group consisting of character, photography, and a mixture of character and photography, such that if the document original is with character, the step of correcting the amount of deviation is enabled under a setting of relative ease for correcting the amount of deviation in data writing position; if the document original is with photography, the step of correcting the amount of deviation operates to carry out one of being disabled, and being enabled under another setting of relative difficulty for correcting an amount of deviation in data writing position; if the document original is with mixture of character and photography, the step of correcting the amount of deviation operates to carry out one of being disabled, and being enabled under another setting of relative difficulty for correcting the amount of deviation in data writing position; and if the document original is with other than character, photography, and a mixture of character and photography, the step of correcting the amount of deviation operates to carry out one of being disabled, and being enabled under another setting of relative difficulty for correcting the amount of deviation in data writing position.

Furthermore, the operation of shifting arbitrarily the phase of picture element clocks by the step of correcting a dot forming position is carried out based on scaling error factors of the at least two laser diodes.

In another aspect, a computer program product is disclosed herein for use with the optical writing system. The computer program product includes a computer usable medium having computer readable program cede means embodied in the medium for causing the steps of correcting data written by the optical writing system, in which the computer readable program code means includes first correction means for scanning data of two laser diodes by one scanning movement with the polygonal mirror, and correcting a dot forming position for the terminating edge in the main scanning direction by shifting arbitrarily the phase of picture element clocks; second correction means for correcting the amount of deviation in data writing position along the vertical scanning direction to be at least approximately one line width; first means for calling up from the exterior to subsequently operate the first correction means; and second means for calling up from the exterior to subsequently operate the second correction means.

In another aspect, a program storage device is disclosed herein being readable by a machine, tangibly embodying a program of instructions executable by the machine to perform the method steps of correcting data written by the optical writing system, in which the method steps includes scanning data of two laser diodes by one scanning movement with the polygonal mirror, correcting a dot forming position for the terminating edge in the main scanning direction by shifting arbitrarily the phase of picture element clocks, and correcting the amount of deviation in data writing position along the vertical scanning direction to be approximately one line width.

The optical writing system and image forming apparatuses incorporating the optical writing system disclosed herein can offer several advantages over similar systems previously known.

For example, it becomes feasible to control image quality at user's own discretion on full color images which may be formed in a variety of qualities resulted from the difference in wavelength, and power output of respective LDs and in the beam pitch between the LDs, so that the selection can properly be made regarding hue variations in half tone image portions formed with dither patterns, whereby excellent image qualities can be maintained.

Also, difficulties characteristic to the full color image formation using two or more LD light sources can be alleviated regarding the positioning precision for forming proper hues.

In addition, since both first and second correction means are enabled simultaneously in parallel with one another, the stabilization of picture images at the terminating edge in the main scanning direction and the elimination of the difficulties of positioning precision for forming proper hues both can be achieved.

Having described the present disclosure in general, the following examples are provided further to illustrate preferred embodiments of the invention.

FIG. 1 is a diagrammatic block diagram illustrating the overall functional construction of a control system included in an image forming apparatus as a digital full color duplication apparatus disclosed herein.

Referring to FIG. 1, the control system includes at least a main controller 108, a FAX controller 102 connected to the main controller 108, a printer controller 104, an input image controller 106, a write controller 110, a key board section 107, and a memory section 103.

In addition, there connected are a FAX I/F 101 to the FAX controller 102, a host I/F 103 to the printer controller 104, a document read section 105 to the input image controller 106, and an image printing section 111 to the write controller 110, respectively.

The FAX I/F 101 is an interface with FAX application and serves to transfer FAX data sent and received. The FAX controller 102 is configured to perform proper processing on the FAX data transferred between the FAX I/F 101, and the host I/F 103 carries out data transfer from either the host or network.

The printer controller 104 is configured to process the data from the host I/F 103 by means of the controller, and the document read section 105 operates to read document originals through either a document platen or ADF (automatic document feeder). The input image controller 106 is capable of inputting and processing the document images read by the document read section 105.

The key board section 107 is provided with keys each controlling the operation of the digital full color duplication apparatus (hereinafter referred to as duplication machine) disclosed herein. These keys are each assigned in use for selection/setting of various applications, number of copy, sheet size, enlargement/reduction, user program (UP) and service program (SP) and so on, and clearing the mode previously set, and instructing operation start/stop.

The main controller 108 is configured to perform overall control of the data transfer from each of applications for the duplication machine main, and assumes the communication between control circuits such as, for example, CUP and others for controlling peripheral applications, timing control, and command I/F.

The memory section 109 is configured to store image data from the FAX controller 102, printer controller 104, and input image controller 106.

The write controller 110 is configured to set properly the image regions with respect to image data acquired from the main controller 108 to conform to the size of copy sheets, and carry out LD modulation to feed subsequently to engine sections of the duplication machine.

In addition, the image printing section 111 serves as the section for printing images on copy sheets by means of a photoreceptor (OPC), an intermediate transfer belt and other, and fixing, then outputting resulting images.

Incidentally, the CPU is configured to perform various controls by executing programs stored in ROM (not shown) utilizing RAM (not shown) as a working area.

The duplication machine incorporating the noted control system is configured to control several sections responding to instruction signals entered through the key board section 107, and initiate the print operations by instruction signals from the main controller 108.

It may be added the present invention is applied primarily to the key board section 107, main controller 108, and write controller 110.

In addition, these sections 107, 108, and 110 are configured to be implemented by computer programs. While these programs are stored in storage units of respective units in advance, further program data may also be utilized after either being upgraded or downloaded onto known storage media by way of known storage media devices such as, for example, CD-ROM and SD-card, driven by server connected to network system (not shown) or by storage media drive.

In the case of copying operations with the duplication machine, the main controller 108 instructs to transfer the image data from the input image controller 106 to the write controller 110. The write controller 110 then operates to drive the image printing section 111 based on the thus transferred image data and the image data are printed. By repeating these steps by the write controller 110 (using write units of FIG. 2) along both main and secondary scanning directions, the printing operation continues to form images on multiple copy sheets.

Figure 2:
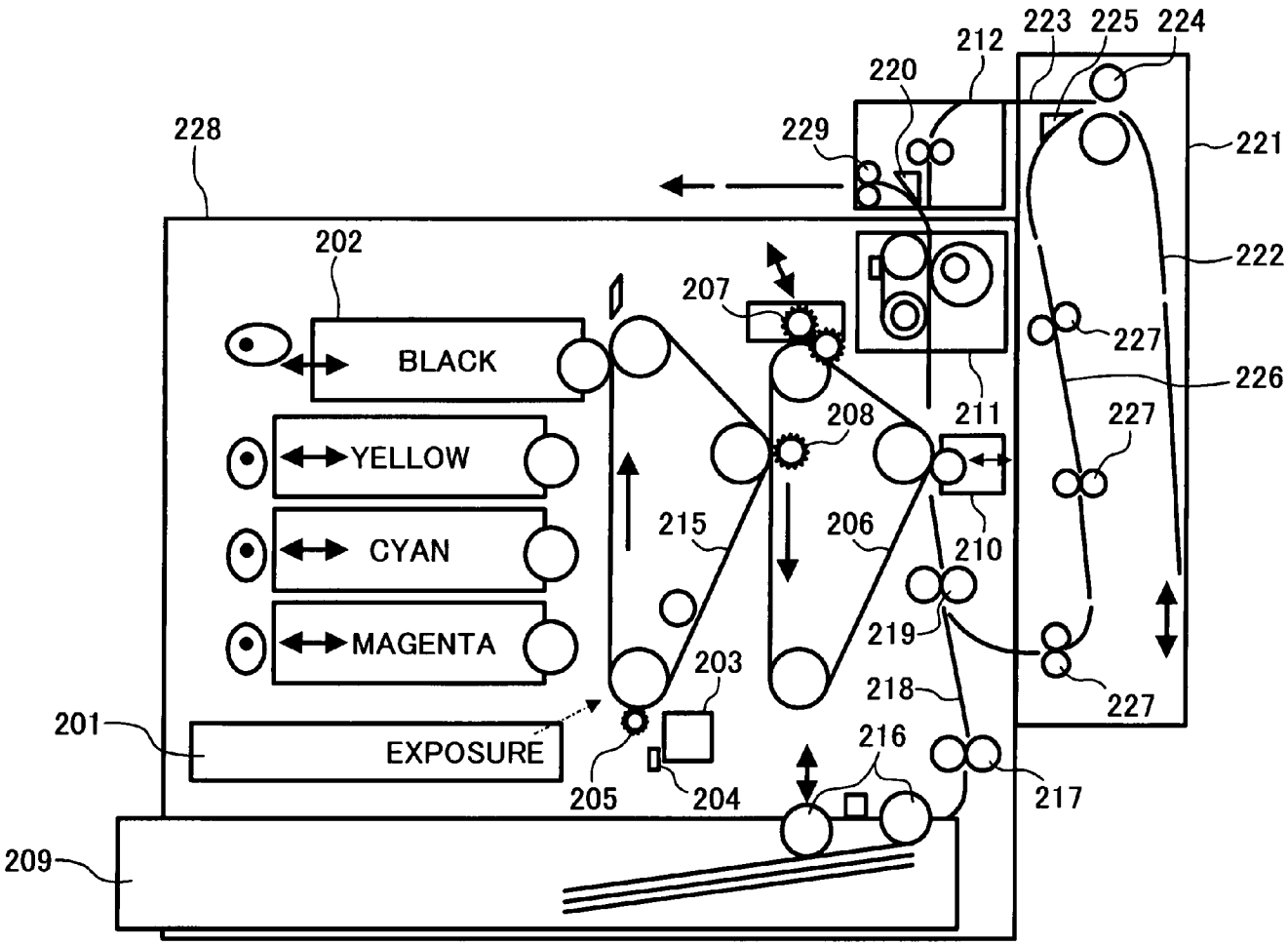
FIG. 2 is a diagrammatic schematic side view illustrating the construction of a duplication machine according to one embodiment disclosed herein.

FIG. 2 is a diagrammatic schematic side view illustrating the construction of a duplication machine 100 according to one embodiment disclosed herein.

Referring to FIG. 2, the duplication machine 100 includes an image forming system, a write (exposure) system including an optical system, a transfer system, a fixing system, a sheet feeding system, a duplex sheet feeding system, and a sheet disposal system.

The image forming system is provided at least with a photoreceptor belt 215; a charging unit 205 for charging the photoreceptor belt 215; a developing unit 202 for developing latent images into toner images in respective colors, consisting of magenta, cyan, yellow, and black developing stations 202M, 202C, 202Y, and 202K, respectively; a photoreceptor cleaning unit 203 for removing residual toner particles remaining on the photoreceptor belt 215; and a discharging unit 204 for discharging the surface of the photoreceptor belt 215 to be reused in the forthcoming developing cycle.

Figure 3:
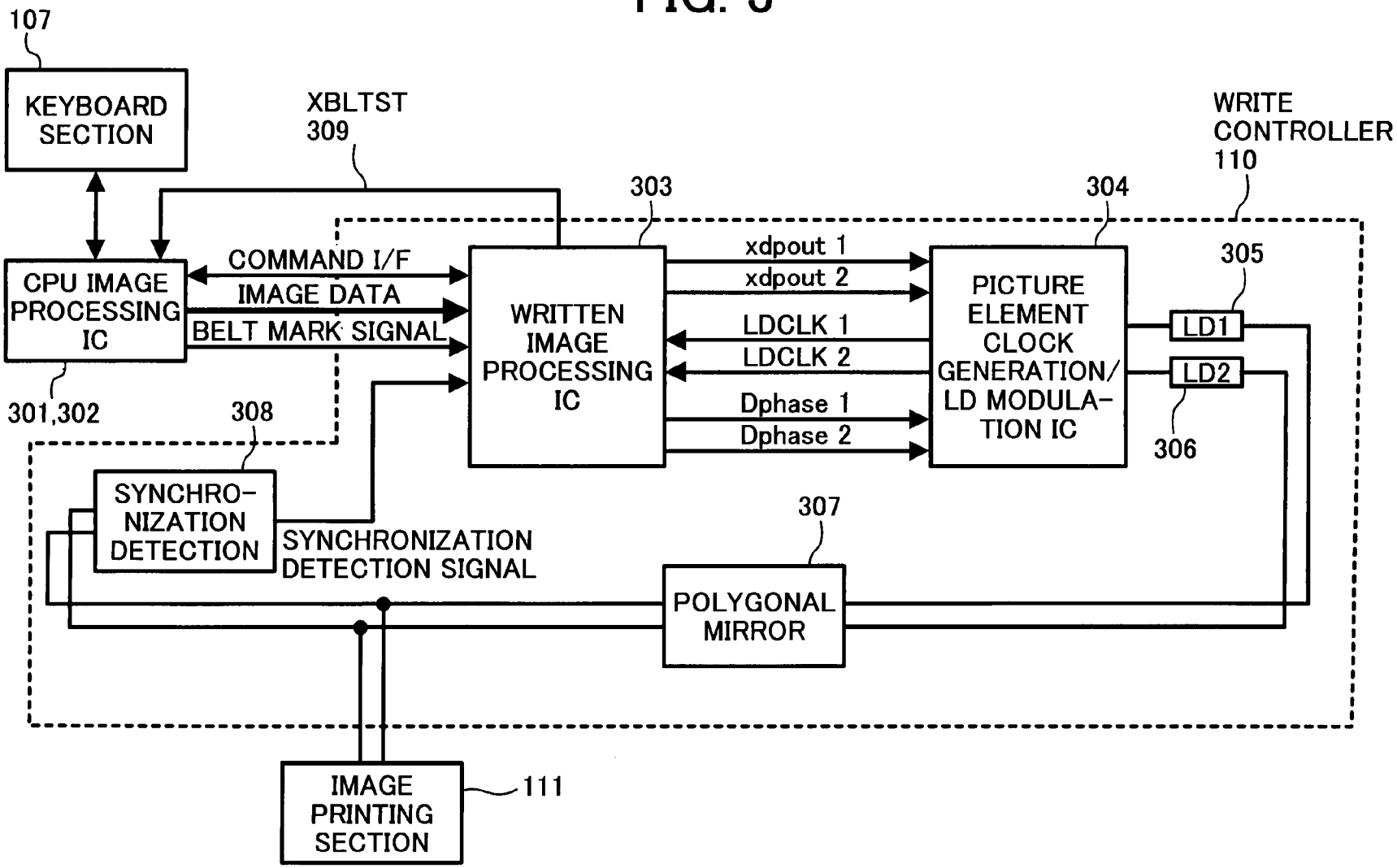
FIG. 3 is a diagrammatic block diagram illustrating the internal structure of the write controller of FIG. 1.

The write (exposure) system corresponds to the write controller 110 of FIG. 3, and includes a written (recorded) image processing IC 303, a picture element clock generation/LD modulation IC 304, first and second laser diodes (LDs) 305 and 306 (which are respectively shown as LD1 and LD2 in FIG. 3), an optical system including at least a polygonal rotating mirror 307, and a synchronization detection unit 308, so that the images are subjected to writing (exposure) onto the photoreceptor belt 215 to form latent images in respective colors.

The transfer system is provided with an intermediate transfer belt 206; a primary transfer brush 208 for use in transferring toner images from the photoreceptor belt 215 to the intermediate transfer belt 206; a secondary transfer roller 210 for transferring the toner images, which are previously transferred to the intermediate transfer belt 206, to copy sheets (transfer materials); and a cleaning brush roller 207 for removing toner particles remained after the image transfer.

The fixing system for fixing full color images onto copy sheets through heating and pressurization includes at least a fixing unit 211 of the fixing belt type placed downstream of the traveling direction of paper sheet.

The sheet feeding system includes a sheet feeding tray 209 for feeding paper sheets in use for image formation, a conveyor roller 217 for leading out the sheets out of the sheet feeding tray 209 and feeding forward to conveying path 218, and a registration roller pair 219 for sending the sheets out in the proper timing determined by the leading edge of the image on the intermediate transfer belt 206 in secondary transfer unit provided with the secondary transfer roller 210.

The duplex sheet feeding system includes a duplex feeding unit 221 provided with a branching unit 212 and a switchback path 222.

The branching unit 212 includes a branching gate or finger 220 for selectively switching the feeding path of an image fixed sheet to either the disposal path or that leading to duplex feeding unit 221.

The duplex feeding unit 221 is provided with a sheet sending-in path 223 for sending the sheets in from the branching unit 212 and then leading to the switchback path 222, a switchback roller 224 for switching back the sheets sent in from the sheet sending-in path 223, and a further feeding path 226 leading the sheets again toward the secondary transfer roller 210 through the switchback roller 224 by way of branching finger 225, so that the feeding path 226 operates to lead the sheets, which are inverted by duplex feeding unit 221, to the nip portion of registration roller pair 219.

The sheet disposal system includes a sheet disposal tray 228 and a sheet disposal roller 229 for disposing the sheets conveyed through the branching unit 212 to the sheet disposal tray 228.

The image forming section (duplication machine 100) incorporating the thus constructed write controller 110 operates as follows in brief.

Namely, by irradiating laser light beams emanated from write unit 201 (the same section as the write controller 110 of FIG. 1), latent images are formed on the photoreceptor belt 215, and the toner development is carried out at the developing stations 202M, 202C, 202Y, and 202K in colors of magenta, cyan, yellow, and black, respectively.

In addition, the discharging/charging, and cleaning of the photoreceptor belt 215 is then carried out by the charging unit 205, discharging unit 204, and photoreceptor cleaning unit 203, respectively.

Thereafter, the intermediate transfer is performed onto the intermediate transfer belt 206 by the intermediate transfer belt 206, cleaning brush roller 207, and primary transfer brush 208.

Subsequently, the thus formed images on the intermediate transfer belt 206 is transferred by the secondary transfer roller 210 onto the sheets conveyed from the sheet feeding tray 209, so that images are formed on the sheets.

Furthermore, these images formed on the sheets are subjected to the fixing with heat, and conveyed through the branching unit 212 to be directed to either the disposal path or that leading to duplex feeding 223.

By carrying out these sequential steps, the printing or copying is achieved regarding the data inputted from the host by way of the controller 102.

In the image forming apparatus with the above noted construction, there detailed herein below are the write unit 201 of FIG. 2, and the main controller 108, the write controller 110, and key board section 107 of FIG. 1, to be incorporated into a type digital full color duplication apparatus provided with two LD light sources according to one embodiment disclosed herein.

The digital full color duplication apparatus includes at least two laser diodes (LD 305 and 306) and a polygonal mirror 307, and has several capabilities which may be operated simultaneously such as scanning the data of two LDs by one scanning movement with the rotating polygonal mirror 307, correcting the dot forming position for the terminating edge in the main scanning direction by shifting arbitrarily the phase of picture element clocks in order to compensate the difference in optical scanning length possibly caused by the difference in wavelength between the two LDs, and correcting the amount of shear in data writing position along the secondary (vertical) scanning direction to be at least approximately one LD line width.

Also, in the digital full color duplication apparatus provided with the capability of calling and then executing each of the above noted capabilities by external setting, this duplication apparatus is configured to call and then execute by external setting the capability of correcting the dot forming position for the terminating edge in the main scanning direction by shifting arbitrarily the phase of picture element clocks.

FIG. 3 is a diagrammatic block diagram illustrating the internal structure of the write controller 110 incorporated into write unit 201 of FIG. 2.

Being connected to write controller 110, the main controller 108 is provided with CPU 301 and image processing IC 302, and configured to transfer image data to the written image processing IC 303 by way of command I/F, properly set the written image regions by setting registers, and transfer resulting image data.

In addition, the picture element clock setting/LD modulation IC 304 is configured to emanate LD beams from the first and second LDs, 305 and 306, deflect these beams by the rotating polygonal mirror 307 to subsequently be received by the synchronization detection unit 308, so that synchronization detection signals are generated corresponding to the deflected beams.

Furthermore, the picture element clock setting/LD modulation IC 304 is also configured to input synchronization signals for respective LDs, xdpout1 and xdpout2, which are each formed by synchronizing the synchronization detection signals by the written image processing IC 303, and output to feedback LDCLK1 and LDCLK2 to the written image processing IC 303.

On the other hand, the capability of shifting arbitrarily the phase of picture element clocks for the first and second LDs, 305 and 306, is achieved by phase shifting signals, Dphase1 and Dphase2, each outputted from the written image processing IC 303 to the picture element clock setting/LD modulation IC 304.

Figure 4:
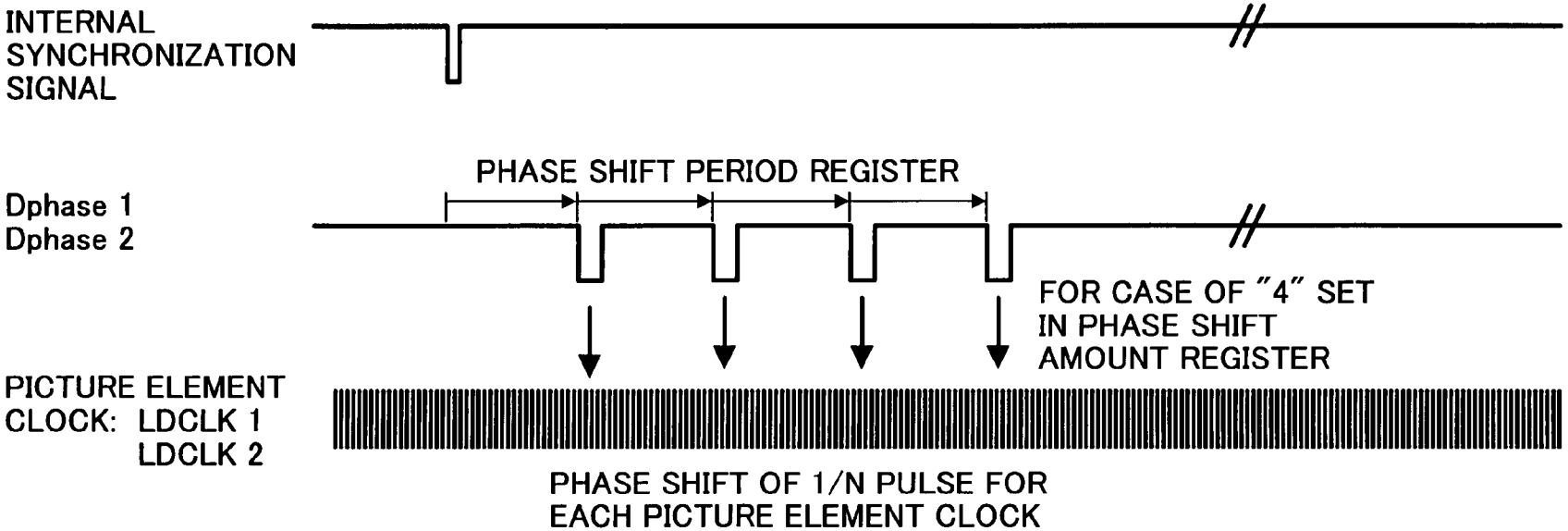
FIG. 4 includes a timing chart illustrating the timing for applying pulses during phase shift.

As illustrated in the timing chart included in FIG. 4, the timing for outputting Dphase1 and Dphase2 signals is determined by set values input to the written image processing IC 303 which incorporates two kinds registers, one for the period, and the other for the amount of the phase shift (i.e., phase shift period register and phase shift amount register).

There exemplified in FIG. 4 is the case where the period of the phase shift may be taken arbitrarily from the phase detection signal, while the amount of the phase shift is set to be four.

By way of a further example on the principle of the phase shift, the input terminals for Dphase1 and Dphase2 in the picture element clock setting/LD modulation IC 304 are configured to delay the phase of Dphase1 and Dphase2 by one eighth of the period at every rising edge.

Although a drawing is abbreviated herein, the control is achieved so as to adjust to coincide horizontal synchronization signals with the noted phase to a precision of 2N times of the frequency utilizing the leading and falling edges of the clocks of N times of picture element clocks (where N is taken to be four or more depending on the register setting).

This is achieved in respect to the circuit function by selecting two picture element clocks generated from the inverted and re-inverted portions of the N-times picture element clocks with respect to the phase of horizontal synchronization signals.

Accordingly, when Dphase1 and Dphase2 signals are input to the present circuit, this circuit result in its capability of prolonging picture element clock time by the factor of 1/(2N) by switching to invert and re-invert the N-times picture element clocks as mentioned above.

In addition, it is sufficient for the pulse width of either Dphase1 or Dphase2 signal during the period at the 'Low' level to be equal to or larger than that of picture element clock.

The amount of delay in the phase produced by the phase shift can be controlled in an arbitrary position in the main scanning direction and this control is feasible independently for each of the first and second LDs, 305 and 306.

Namely, with the phase shift capability in the present disclosure, it is not intended to bring the horizontal synchronization signals into coincidence with the phase of picture element clocks, but to control the disagreement of pictorial images in the main scanning direction caused by the optical wavelength difference between two LDs. The above noted capabilities are set by entering appropriate values through the external key board section 107.

Accordingly, by performing addressing operations through the key board section 107 and setting the values to be input into the phase shift amount register for each LD, the set values are reflected to various sections and stored by way of CPU 301 included in the main controller 108.

In addition, the values to be input into the phase shift period register may alternatively be made available in advance by separate software.

As a result, by shifting the phase of picture element clock for one selected LD at an arbitrary position in the main scanning direction with the thus set values, it becomes feasible to compensate the positional accuracy of the synchronized position for the LDs, regarding the variation of image characteristics caused by the deterioration over time, and frequency fluctuation of the LDs, so that picture images at the terminating edge in the main scanning direction can be stabilized.

Furthermore, it becomes also feasible to reduce subtle variations of the hues in halftone imaging area possibly caused during continuous printout of full color images.

Figure 5:
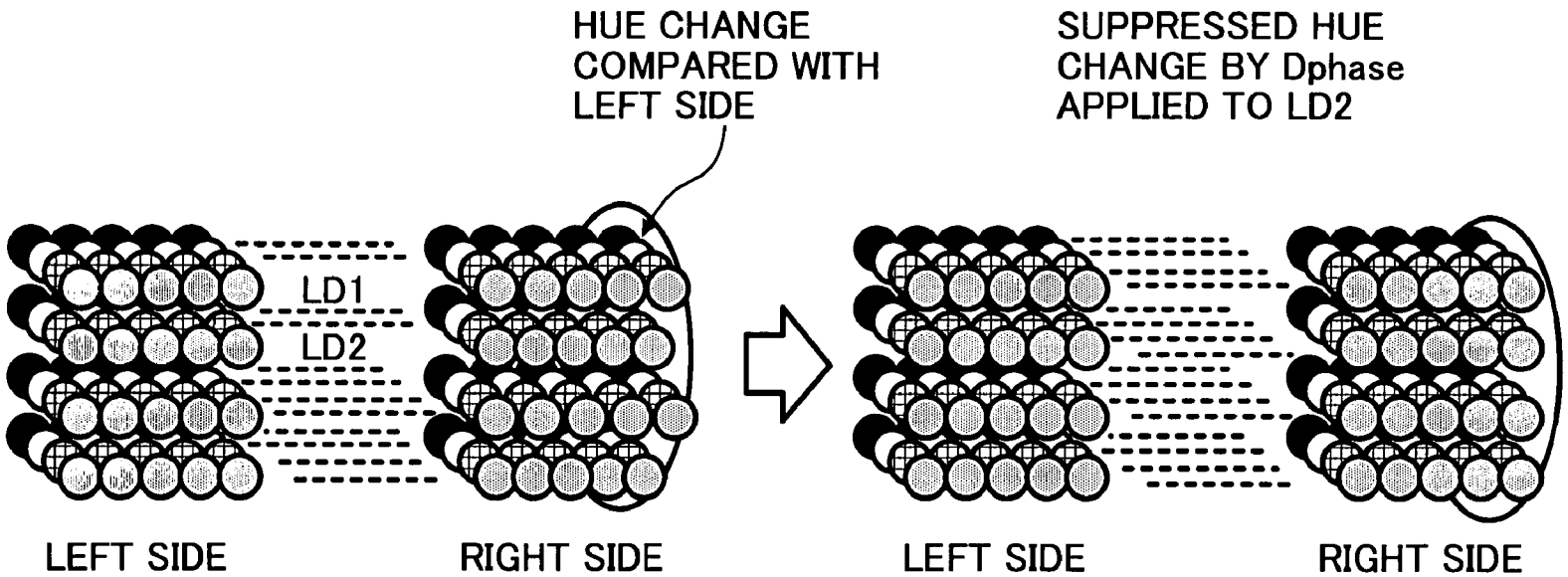
FIG. 5 is a drawing typically illustrating the effects on the deviation of cyan images when the phase shift is made for the second LD.

FIG. 5 is a drawing typically illustrating the effects on the deviation of cyan images when the phase shift is made for the second LD 306.

In addition, by providing in advance the mode (SP mode) which enables the phase shift setting only by service programs, any improper settings by a user may be prevented, so that protective measures can be taken for preventing unnecessary deterioration in image qualities.

It may be added herein that the SP mode is accessible in general through addressing a key on the operation board preset for each machine and usually inaccessible by an ordinary user.

In contrast, a user mode (UP mode) is made available to the user, which releases several operations regarding information on initial settings of adjustments, counter reading, various inquiries, and other similar information.

Figure 6:
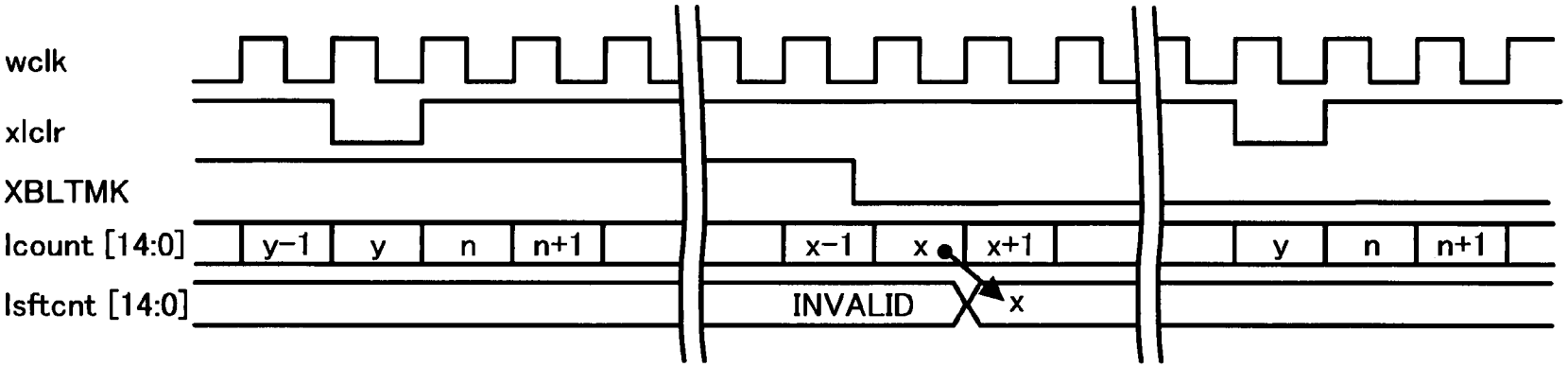
FIG. 6 includes a timing chart illustrating the sequence of one-line shift capability for controlling the amount of positional deviation in the vertical scanning direction to be one line.

FIG. 6 includes a timing chart illustrating the sequence of one-line shift capability for controlling the amount of positional deviation in the vertical scanning direction to be one line at least.

Namely, these steps enable the capability with the write controller 110 of decreasing the amount of positional deviation during image writing in the vertical scanning direction by one LD beam width (by one line) by calling and then executing by setting from the exterior (key board section 107).

As described earlier, a two-beam writing system is utilized as the write unit 201 in the present embodiment, and the synchronization detection signals from the intermediate transfer belt 206 (FIG. 2) and synchronization detection unit 308 are asynchronous with one another. The maximum amount of image deviation in respective colors may therefore cover over the width of two lines in the vertical scanning direction.

As a result, there provided in this embodiment is the capability of decreasing the amount of positional deviation during image writing in the vertical scanning direction to be one line at most (i.e., one-line shift capability), and on/off determination is additionally carried out on this capability.

The one-line shift capability is configured to decrease the positional deviation in the vertical scanning direction by half to be apparently one line by shifting the data of the first LD 305 to those of the second LD 306, while 'white' data are given (i.e., instructing no image printing) to the first LD 305 instead (which is illustrated herein later on in FIG. 7B).

This one-line shift capability is need during color printing and moreover two-beam printing. In addition, in order to avert the difficulty of a too large power output difference between two LDs, an authorization register of one-line shift is provided, which operates not to execute the one-line shift capability when the authorization register gives no permission.

The timing for deciding the one-line shift execution is found, utilizing, as a trigger, an XBLTST signal 309 which is generated through processing by the written image processing IC 303, a belt mark signal (XBLTKM) acquired by detecting a belt mark on the intermediate transfer belt 206 of FIG. 2, by latching a main scanning counter value (lcount) onto lsftcnt (FIG. 6) with the picture element clock (wclk), and comparing with the value set beforehand in a comparison/decision register, lsftref_r, so that the execution of the one-line shift is decided as described herein below.

Incidentally, xlcr designates an internal synchronization signal in the written image processing IC 303.

The above noted decision on executing the one-line shift is made by comparing with the value in the comparison/decision register lsftref_r.

Namely, if lsftcnt>lsftref_r, "1" (one-line shift is on) is set in lsfton register. In contrast, if lsftcnt≦lsftref_r, "0" (one-line shift is off) is set. These values are reflected onto the one-line shift control register lsfton during the period of XBLTST signals (FIG. 3).

It may be noted herein that, although the main scan counter and comparison/decision register lsftref_r are each of 15 bits, they may alternately have any arbitrary bit.

In addition, the setting is made through the key board section 107 in a similar manner to the previous line shift. Namely, by entering appropriate values through the key board section 107 and setting the values to be input into the one-line shift enabling register, the set values are reflected to various sections and stored by way of CPU 301 included in the main controller 108.

Incidentally, the notations y and n of FIG. 6 each designate the maximum and minimum values for the main scan counter, respectively.

Figure 7A:
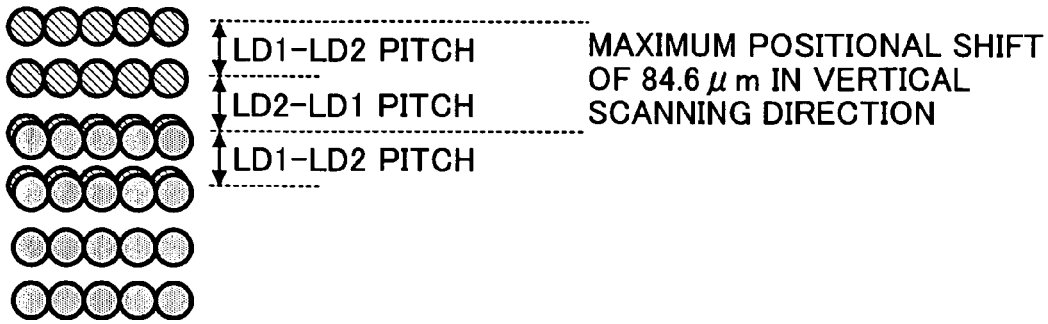
FIG. 7A illustrates the result from the setting of disabling one-line shift operation.
Figure 7B:
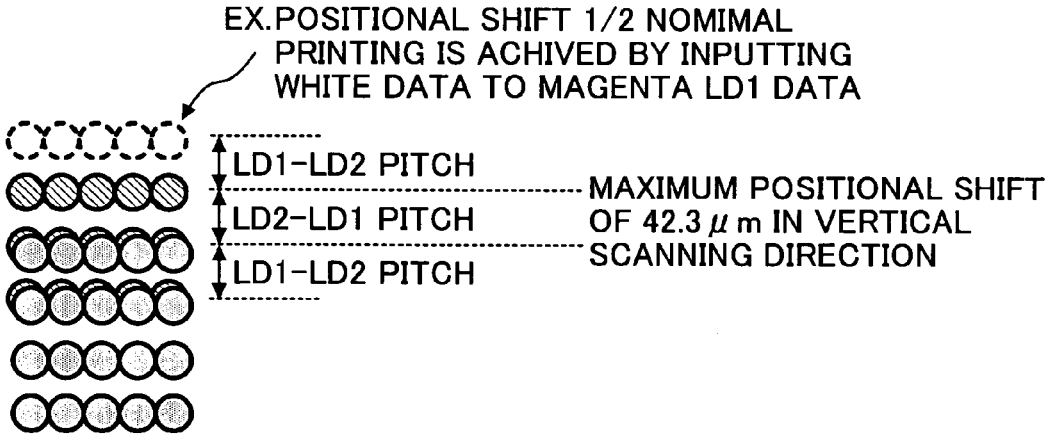
FIG. 7B illustrates the result from the setting of enabling the one-line shift operation.
Figure 7C:
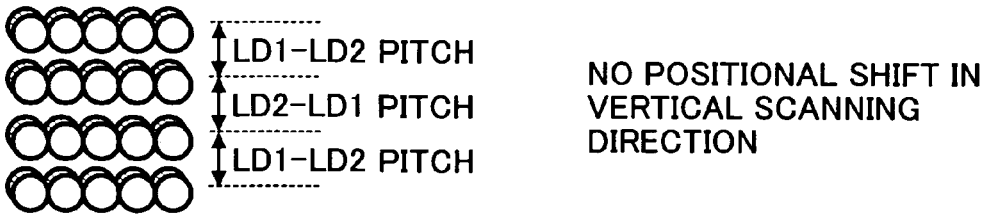
FIG. 7C illustrates the case without positional deviation in the vertical scanning direction.

FIGS. 7A, 7B, and 7C are drawings each typically illustrating the results from the setting, in which FIGS. 7A and 7B correspond to disabled, and enabled one-line shift operation, respectively, while FIG. 7C corresponds to the case without positional deviation in the vertical scanning direction, where the beam pitch for the LDs 305 and 306 is taken to be 1/(600×25.4)=42.3 μm.

When the decision timing of disabling/enabling one-line shift is not exceeded, the one-line shift is not enabled and images are output in order of the first LD 305, second LD 306, first LD 305, and second LD 306.

The amount of positional shift in this case may reach as large as 84.6 μm (two times of the pitch between the LDs in the vertical scanning direction) corresponding to FIG. 7A, in which the one-line shift capability is disabled.

In contrast, when the timing of belt mark signal input exceeds the decision timing of disabling/enabling one-line shift, the one-line shift capability is enabled, and 'white' data are given to the first LD 305, while the data of the first LD 305 is transferred to the second LD 306.

Subsequently, the shifting operation is repeated by line, in which the data of the second LD 306 is transferred to the first LD 305, the data of the first LD 305 is transferred to the second LD 306 and so on, so that picture images are output.

The amount of positional shift in this case may reach as large as 42.3 μm (the same as the pitch between the LDs in the vertical scanning direction) corresponding to FIG. 7B, in which the one-line shift capability is enabled.

On the other hand, in the case where input timing is in coincidence with each other between originally asynchronous two signals, synchronization and belt mark signals, no positional shift in the vertical scanning direction arises as illustrated in FIG. 7C.

Incidentally, the noted two capabilities, one being correcting the dot forming position for the terminating edge in the main scanning direction by shifting arbitrarily the phase of picture element clocks and the other being halving the amount of positional deviation during image writing in the vertical scanning direction to one LD beam width (by one line), can be called and then executed simultaneously through setting on the key board section 107. In this case, the SP mode is adapted to carry out the setting, and the two capabilities may be executed in combination.

By using the two capabilities in combination, the picture image correction is achieved in the main scanning direction (FIG. 5) as well as in the vertical scanning direction (FIG. 7).

As a result, the stabilization in the dot forming position for the terminating edge in the main scanning direction and positional deviation in the hue during image writing become feasible simultaneously.

In addition, the capability of halving the amount of positional deviation during image writing in the vertical scanning direction to one LD beam width (by one line) is provided also with the capability of lifting this capability by setting from the exterior, which is carried out by releasing (disabling) the one-line shift enabling register through the setting on the key board section 107 of FIG. 3.

With the abovementioned circuit construction, the one-line shift enabling register has been set 'ON' (enabling) beforehand. However, the setting may be changed to 'OFF' (disabling), when a deviation in hues of images larger than a predetermined threshold value is detected, being caused by a large power output difference between two LDs and beam pitch deviation.

In this case, the setting for the other another capability of shifting arbitrarily the phase of picture element clocks may remain continued to be operative.

As described herein above, both corrections in the main scanning direction (Dphase) and in the vertical scanning direction (one-line shift) can be executed by a user through setting on the key board section 107.

Figures 8, 8A, 8B:
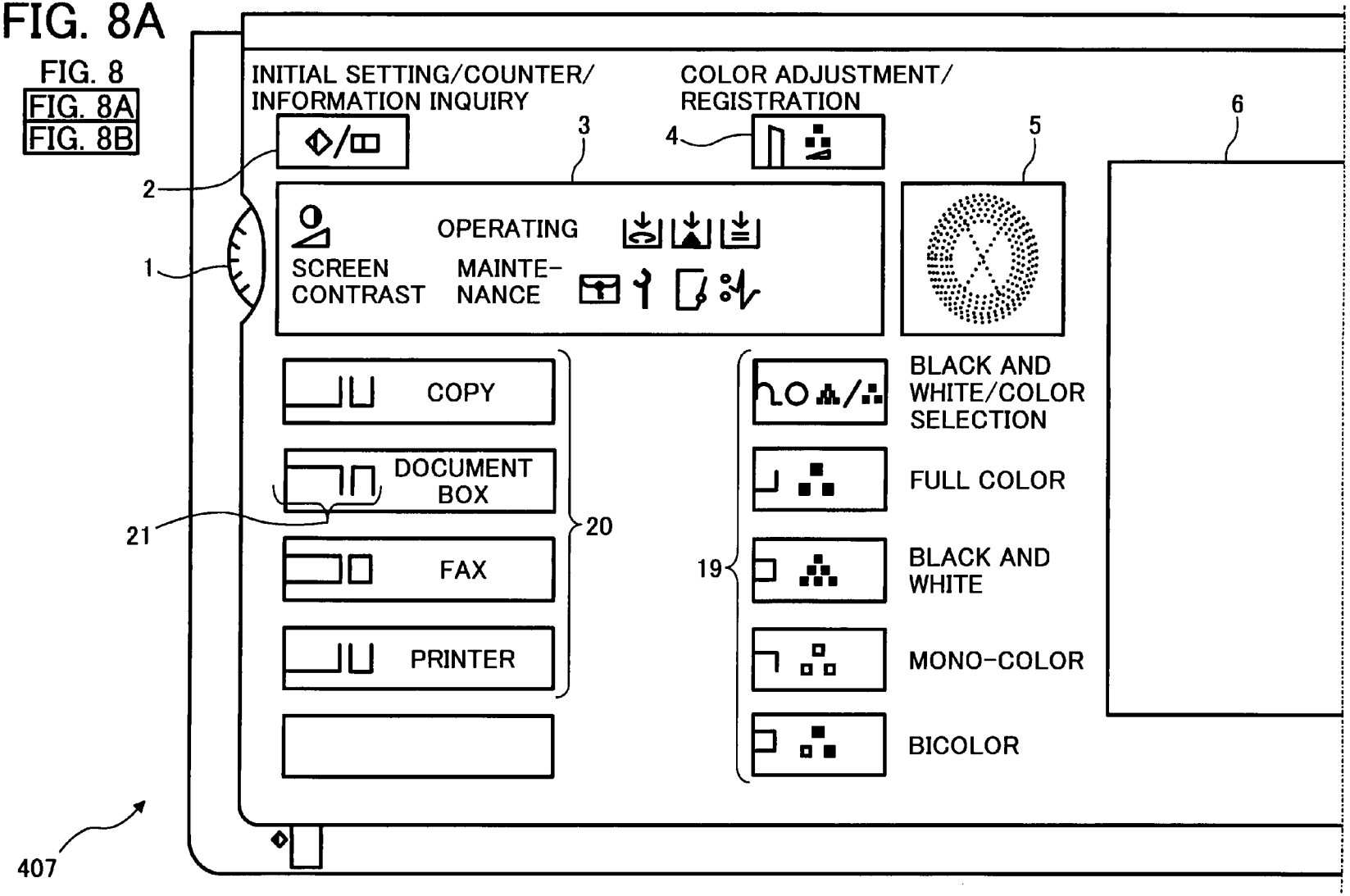
FIG. 8 is a frontal view illustrating an operation panel on the key board section of duplication machine 100 according to one embodiment disclosed herein.
Figure 8B:
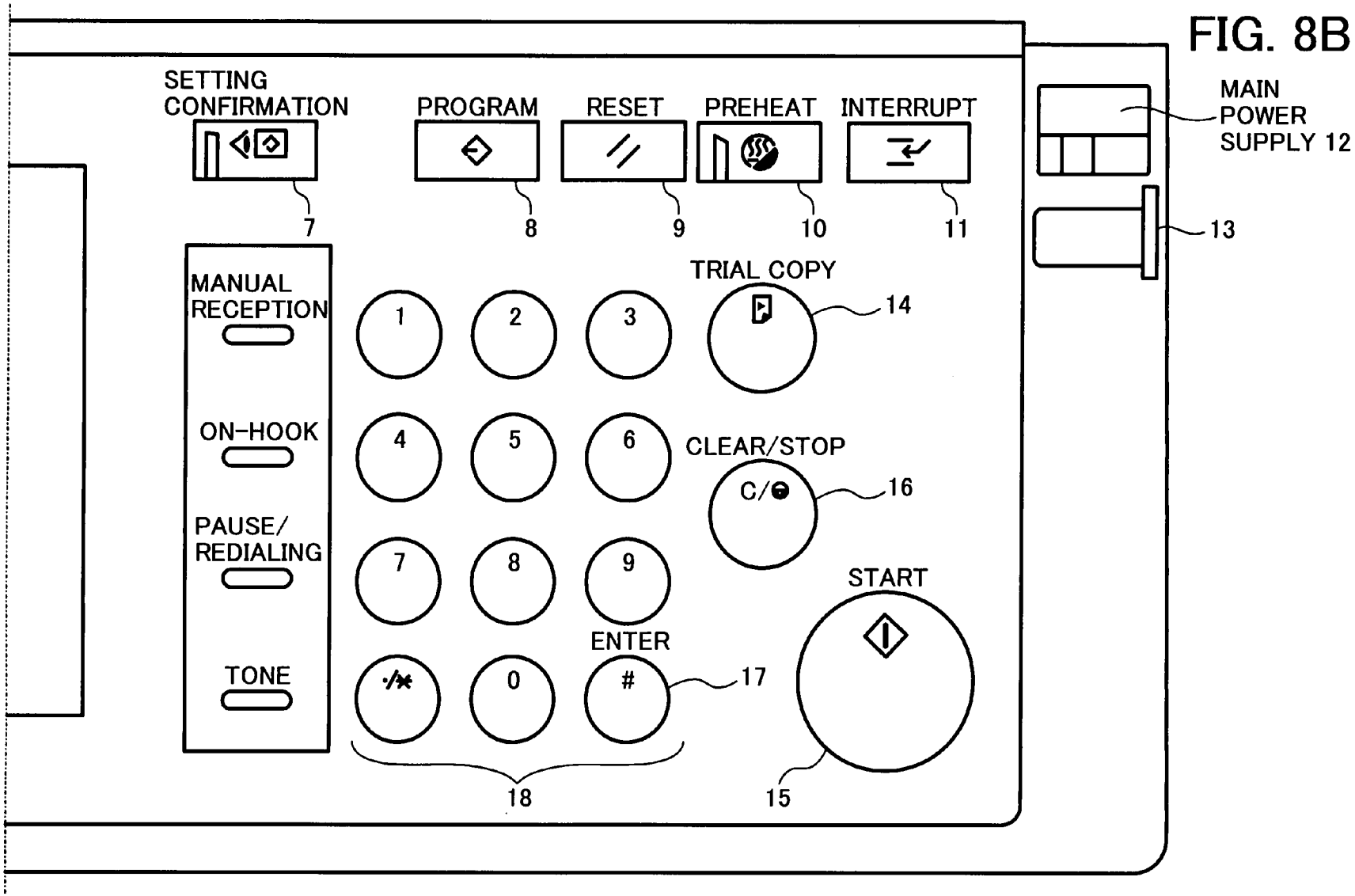

FIG. 8 is a frontal view illustrating an operation panel 407 on the key board section 107 of duplication machine 100 according to one embodiment disclosed herein.

The operational panel 407 is of general purposes provided thereon with several keys and screen such as a dial for screen contrast adjustment 1, a key for initial setting/counter/information inquiry 2, a display unit for displaying error if any and machine condition 3, a color adjustment/registration key 4, a color circle, an operation display screen with the touch panel 6, a setting confirmation key 7, a program key 8, a reset key 9, a preheat key 10, an interrupting key 11, main power supply lamp 12, a power supply 13, a trial copy key 14, a start key 15, a clear/stop key 16, an enter key 17, a numerical keypad 18, a color selection 19, a function key 20, and a functional group display key 21.

Figure 9:
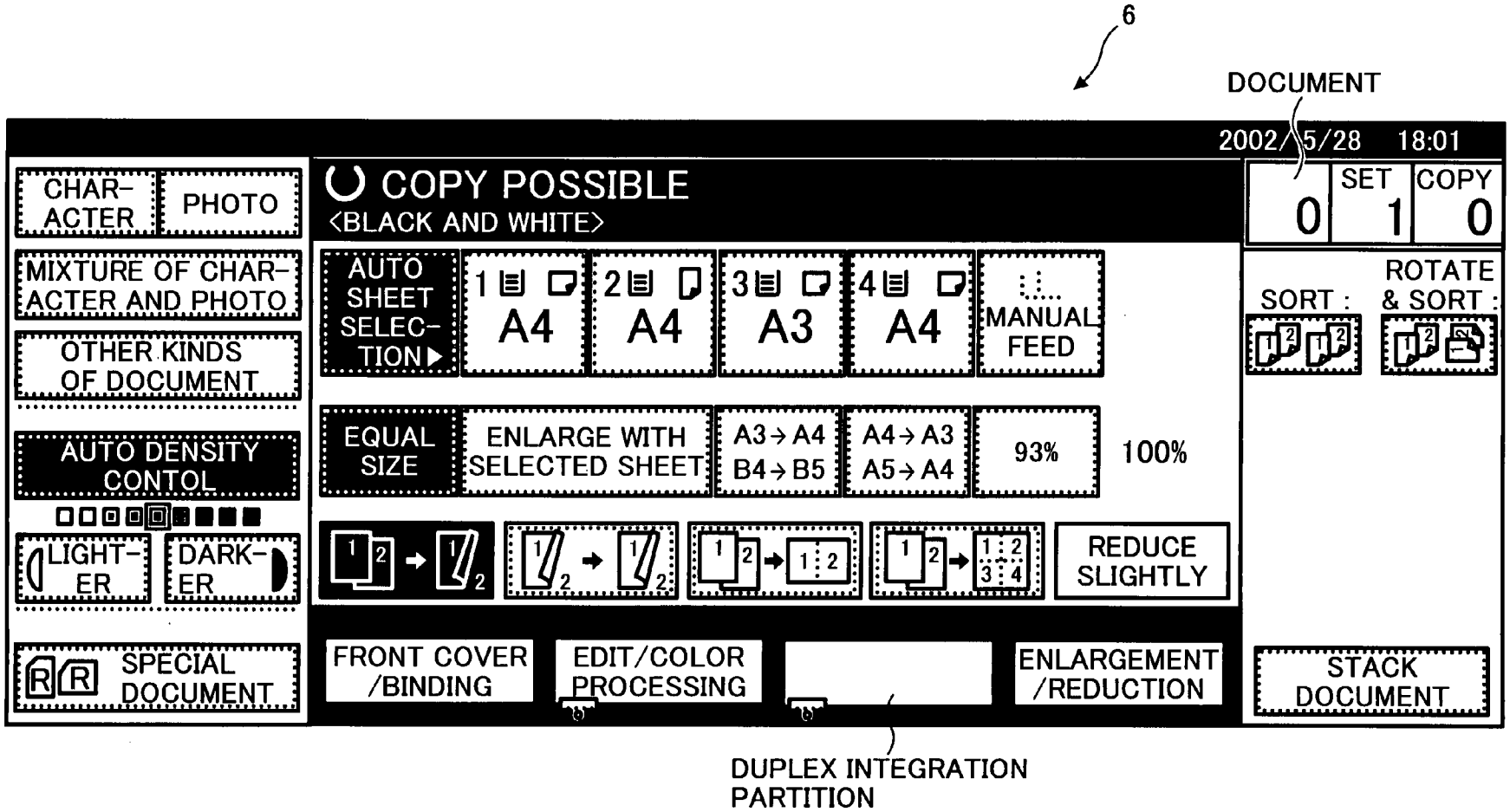
FIG. 9 is a view illustrating a screen displayed on the touch panel 6 of FIG. 8.

FIG. 9 is a view illustrating a screen displayed on the touch panel 6 of FIG. 8.

In the case where corrections are carried out through setting on the key board section 107 (operation panel) according to one embodiment disclosed herein, the registered setting is called by a thrusting operation of the program key 8 and then displayed on touch panel or operation display screen 6.

Since the corrections in the main scanning direction (Dphase) and in the vertical scanning direction (one-line shift) are already registered in advance, a user may select the operation for the desirable correction through the display on the touch panel 6.

Figure 10:
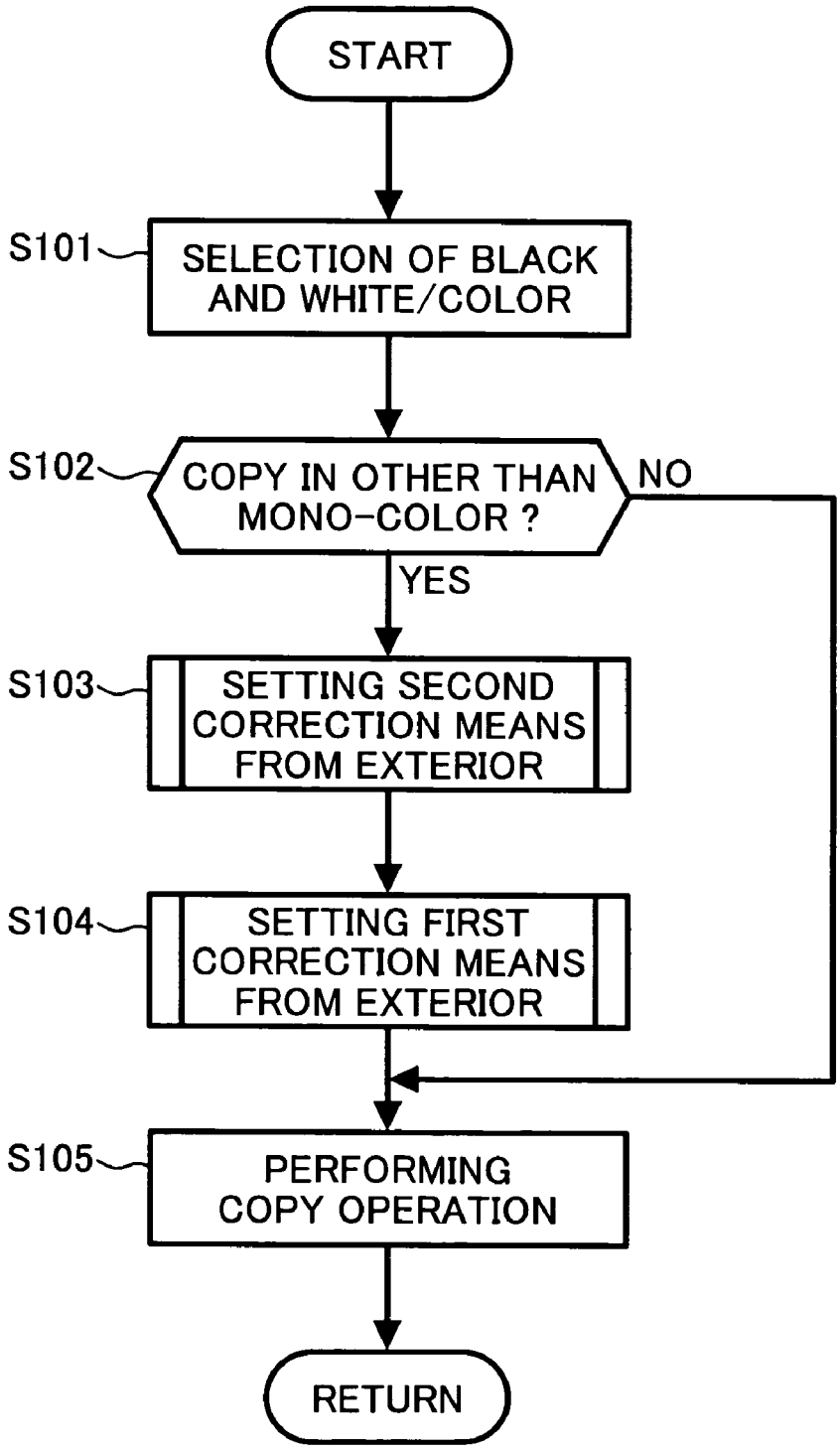
FIG. 10 includes a flow chart illustrating overall process steps in operating correction capabilities in the main, and vertical scanning directions according to embodiments disclosed herein.

Upon selecting the correction operation, there shows up on the operation display screen 6 is a display illustrated in a flowchart included in FIG. 10, for inviting to make a selection from black and white (monochromatic) images and color images, so that proper selection can be made by entering through the color selection key 19 (step S101). Subsequently, an inquiry is made whether the selected operation is color copying other than mono-color by the selection through the color selection key 19 (step S102).

This step is intended to decide whether the color copy is formed by one developer when a color mode is selected in step S101. If the response to the inquiry in step S102 is negative indicating that the color copying is in mono-color, no color shift arises. Then, the copying process proceeds (step S105) as directed and the process returns.

In contrast, if the response to the inquiry in step S102 is affirmative indicating that the copy other than mono-color is the case, a correction in the vertical scanning direction (one-line shift) is carried out first (step S103), subsequently a further correction in the main scanning direction (Dphase) is then made (step S104), the copying process proceeds (step S105), and the process returns.

Incidentally, it is noted that by the mono-color selected in step S102 meant is the color formed by one developer as described earlier. Therefore, the mono color 'red' is not included since this color is formed by not one developer but two developers, magenta and yellow, so that color shift possibly arises in this case.

For example, a case is detailed as illustrated in FIG. 5, in which there shows up some color shift at the right side end point (finish), although the initial position (starting point) for respective picture elements coincide with each other in the main scanning direction.

Figure 11:
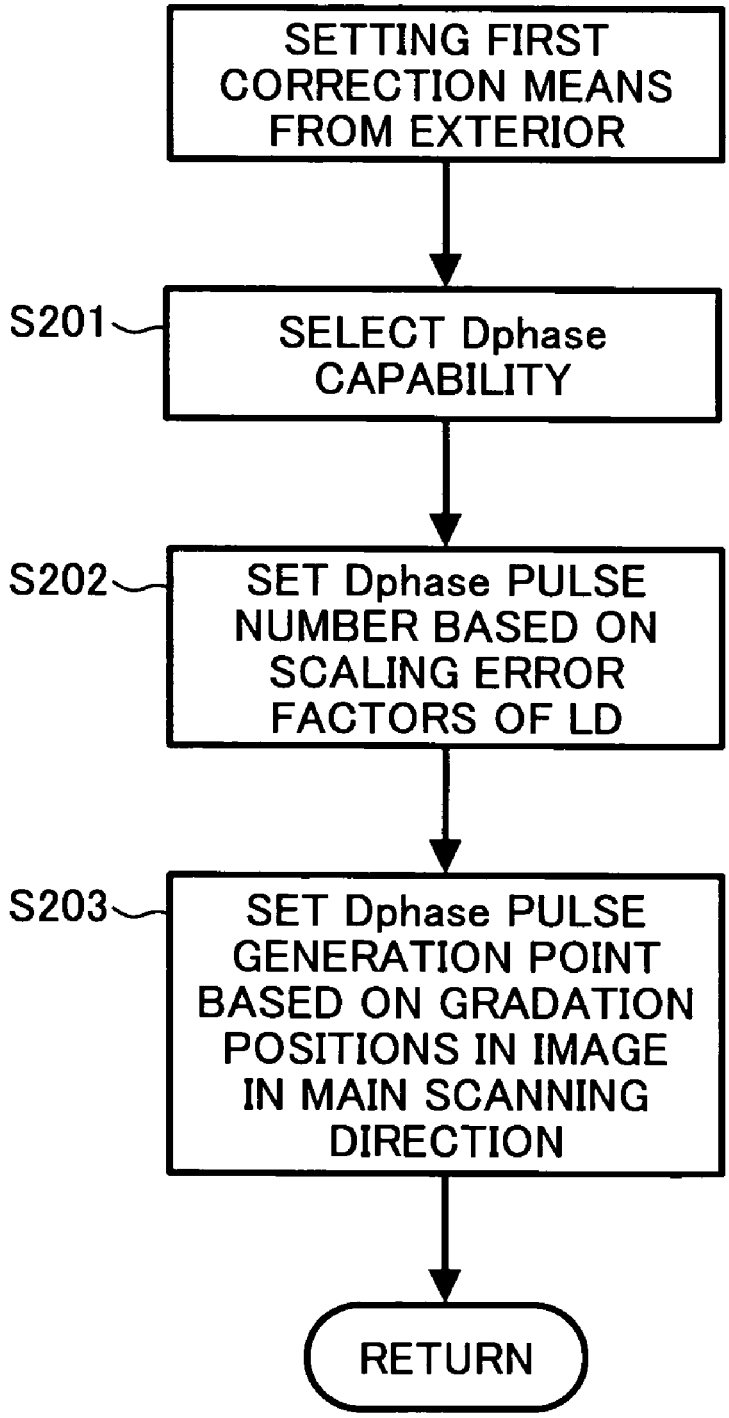
FIG. 11 includes a flow chart detailing the steps in a subroutine for the step S104 of FIG. 10.

Assuming images which include many halftone portions in gray, for example, the first correction (in the main scanning direction) is entered for correcting the images through operation display screen 6. Namely, the Dphase capability is selected through the screen 6 as illustrated in the flow chart included in FIG. 11 (step S201).

Upon the selection, scaling error factors which are tabulated for plural LDs in advance for use in preparing the Dphase capability are shown on the screen 6, so as to facilitate the setting the number of Dphase pulses to be input for proper correction (step S202).

Subsequently, the position for initiating the Dphase pulse generation is set corresponding to the halftone portion of the image (step S203) and the process returns.

The process for setting the position for initiating the Dphase pulse generation corresponding to the halftone portion of the image (step S203) is carried out so that the position of Dphase pulse generation in the main scanning direction is set to be correlated more to halftone portions.

Specifically, when the gradation images (halftone portions) are concentrated at the rear end in the main scanning direction, the Dphase pulse generation position is set toward the rear end, while the positions are set rather uniformly over the scanning direction when halftone portions are dispersed along the direction. As a result, the shift in hues of color images caused by the difference in LD wavelength can be reduced.

On the other hand, the second correction capability in the vertical scanning direction (one-line shift) facilitate to suitably set the selection with or without the one-line shift (enable/disable) and the difficulty level of the setting through the operation display screen 6.

The setting of the difficulty level is carried out by adjusting the value in the aforementioned comparison/decision register lsftref_r based on the comparison of the value of main scanning counter value (lcount) latched onto lsftcnt with the picture element clock (wclk) with that in comparison/decision register lsftref_r.

Figures 12, 12A:
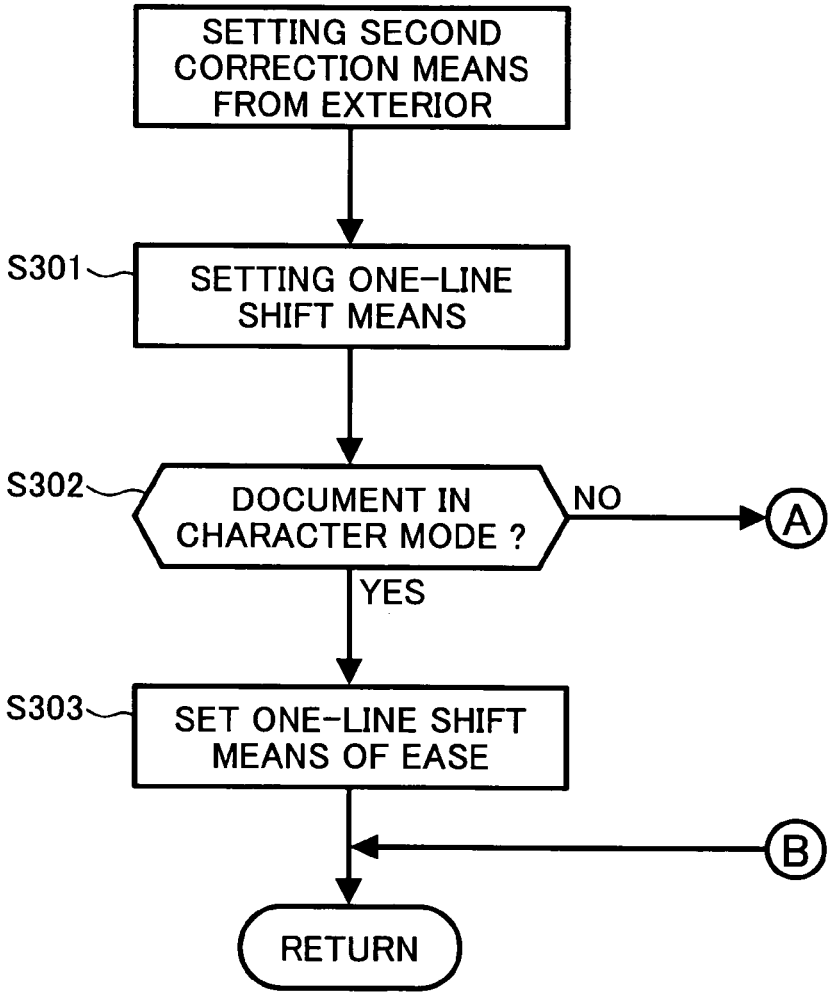
FIG. 12 includes a flow chart illustrating the process steps of the second correction capability in the vertical scanning direction from the exterior.
Figure 12B:
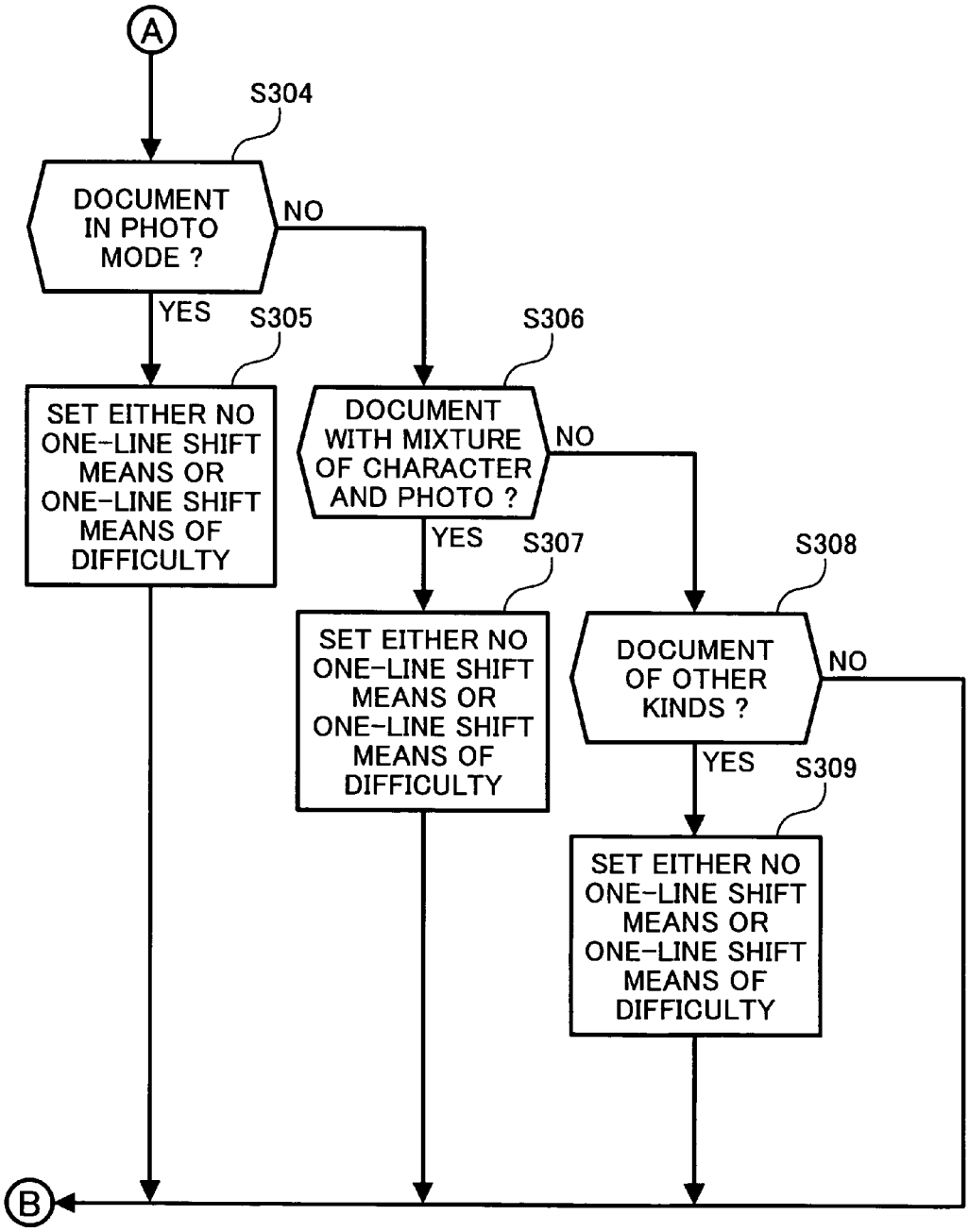

FIG. 12 includes a flow chart illustrating setting process steps from the exterior of the second correction capability (correction in the vertical scanning direction).

Referring to FIG. 12, upon selecting the one-line shift capability through the operation display screen 6 (step S301), an inquiry is made whether a document original is in the character mode (step S302).

If the response to the inquiry in step S302 is affirmative indicating that the document original is in the character mode, the next selection is made (step S303) by entering through the operation display screen 6 regarding the term of 'enabling' the one-line shift capability with relative 'ease' of the one-line shift, thereafter the process returns.

In contrast, if the response to the inquiry in step S302 is negative indicating that the document original is not in the character mode, the process proceeds to step S306 where a further inquiry is made regarding whether the document original is in the mode mixed with character and photographic picture.

If the response to the inquiry in step S306 is affirmative indicating that the document original is in the mode mixed with character and photographic picture, further selection is made (step S309) by entering through the operation display screen 6 regarding the term of 'disabling' the one-line shift capability with 'difficulty' of the one-line shift, then the process returns. In addition, if the document original is found not of the kind other than above noted, the process returns.

The selection of the kinds of document original such as character, photograph, character/photograph, and others is made by entering through the operation display screen 6 of FIG. 9, which is subsequently reflected to the following steps S302, S304, S306, and S308.

As described above, the setting is made to facilitate the following process steps, in that the one-line shift capability is enabled with relative ease of the one-line shift for the document original in the character mode and that the capability is either disabled or enabled only to a limited extent in the photography mode and in the character/photograph mode.

While the selecting operation is described in the present disclosure primarily by entering the first and second corrections through the key board section 107 and operation display screen 6, this operation may also be carried out alternatively by the means additionally provided.

Namely, the thus provided means is for automatically setting the first and second corrections based on images optically readout and the results obtained from the detection on the output images regarding the amount of deviation in dot forming position for the terminating edge in the main scanning direction and positional deviation during image writing in the vertical scanning direction.

In addition, while the selecting operation on the first and second corrections is described primarily by entering through a thrusting operation of the program key 8, this operation may also be carried out alternatively by either providing a further function key separately or allotting the operation capability onto one of existing keys.

For example, among the function key group of FIG. 8, one positioned under the printer key has no allotted function presently, which is now available for further function allotting.

While the present disclosure has been described in connection with the preferred embodiments on digital full color duplication apparatus, it will be understood that it is not intended to be limiting. On the contrary, it is needless to add that the present disclosure is also intended to cover image forming apparatuses in general in inclusive of printers and facsimile apparatuses, incorporating plural LD light sources and optical scanning system.

It is apparent from the above description including example, the optical writing system disclosed herein has several advantages over similar systems previously known.

For example, since the first capability for correcting the dot forming position for the terminating edge in the main scanning direction can be enabled from the exterior, the phase of picture element clocks is shifted properly compensating for the deterioration of LD over time and the variation of LD characteristics caused by frequency fluctuation, so that positional precision from a synchronization point for respective LDs is assured and picture images at the terminating edge in the main scanning direction can be stabilized.

Also, since the second capability for halving the amount of positional deviation during image writing in the vertical scanning direction to one LD beam width is enabled from the exterior, difficulties characteristic to the full color image formation using two or more LD light sources can be alleviated regarding the positioning precision for forming proper hues.

Further, both first and second capabilities are enabled in combination. As a result, it becomes feasible that the phase of picture element clocks is shifted properly compensating for the deterioration of LD over time and the variation of LD characteristics caused by frequency fluctuation, so that positional precision from a synchronization point for respective LDs is assured and picture images at the terminating edge in the main scanning direction can be stabilized, and that difficulties characteristic to the full color image formation using two or more LD light sources can be alleviated regarding the positioning precision for forming proper hues.

In addition, since both first and second capabilities are enabled simultaneously in parallel with one another, the stabilization of picture images at the terminating edge in the main scanning direction and the elimination of the difficulties of positioning precision for forming proper hues both can be achieved.

Still in addition, since the second capability can be lifted from the exterior, it also becomes feasible to control image quality at user's own discretion on full color images which may be formed in a variety of qualities resulted from the difference in wavelength, and power output of respective LDs and in the beam pitch between the LDs, so that the selection can properly be made regarding hue variations in half tone image portions formed with dither patterns, whereby excellent image qualities can be maintained.

By the correction means provided in the optical writing system disclosed herein, therefore, frequency fluctuations and characteristic changes in laser diode over time are compensated, positional precision from a synchronization point is assured for respective laser diodes, picture images at the terminating edge in the main scanning direction is stabilized, and subtle hue variations can be reduced in half tone image portions during repeated full color image formations, whereby excellent image qualities can be maintained.

The process steps set forth in the present description on the optical write system and correction process steps with the system may be implemented using conventional general purpose microprocessors, programmed according to the teachings in the present specification, as will be appreciated to those skilled in the relevant arts. Appropriate software coding can readily be prepared by skilled programmers based on the teachings of the present disclosure, as will also be apparent to those skilled in the relevant arts.

The present specification thus include also a computer-based product which may be hosted on a storage medium, and include instructions which can be used to program a microprocessor to perform a process in accordance with the present disclosure. This storage medium can include, but not limited to, any type of disc including floppy discs, optical discs, CD-ROMs, magneto-optical discs, ROMs, RAMs, EPROMs, EEPROMs, flash memory, magnetic or optical cards, or any type of media suitable for storing electronic instructions.

Additional modifications and variations of the present invention are possible in light of the above teachings. It is therefore to be understood that within the scope of the appended claims, the invention may be practiced otherwise than as specifically described herein.

This document claims priority and contains subject matter related to Japanese Patent Application No. 2003-32588, filed with the Japanese Patent Office on Feb. 10, 2003, the entire contents of which are hereby incorporated by reference.

What is claimed is:

1. An optical writing system comprising:

at least two laser diodes;

a polygonal mirror;

a first correction mechanism configured to receive a first external parameter, scan data of two laser diodes by one scanning movement with said polygonal mirror, and correct, based on the first external parameter, a dot forming position of a terminating edge in a main scanning direction by shifting arbitrarily a phase of a picture element clock; and a second correction mechanism configured to receive a second external parameter, and correct, based on the second external parameter, an amount of deviation in a data writing position along a vertical scanning direction to be approximately one laser diode line width, wherein said second correction mechanism is further configured to receive the second external parameter that includes information indicating that a type of a document is one of a character document, a photography document, a mixed character and photography document, and a non-character and non-photography document, and said second correction mechanism is further configured to enable correction of an amount of deviation in a data writing position in accordance with a first difficulty level when the information indicates that the type of document is a character document.

2. The optical writing system according to claim 1, wherein:

said second correction mechanism is configured to start to correct the amount of deviation based on the second external parameter.

3. The optical writing system according to claim 1, wherein said second correction mechanism is configured to stop correcting the amount of deviation based on the second external parameter.

4. The optical writing system according to claim 1, wherein said first correction mechanism and said second correction mechanism are configured to be controlled separately from each other.

5. The optical writing system according to claim 1, wherein said first correction mechanism is configured to start to correct the dot forming position based on the first external parameter.

6. The optical writing system according to claim 1, wherein said first correction mechanism is further configured to arbitrarily shift the phase of the picture element clock based on a scaling error factor of said at least two laser diodes.

7. The optical writing system according to claim 6, wherein the first external parameter includes the scaling error factor.

8. The optical writing system according to claim 1, wherein said first correction mechanism is configured to stop correcting based on the first external parameter.

9. The optical writing system according to claim 1, wherein said second correction mechanism is further configured to be placed in a state including one of disabled, and enabled to correct an amount of deviation in data writing position in accordance with a second difficulty level when the information indicates that the type of document is a photography document.

10. The optical writing system according to claim 1, wherein said second correction mechanism is further configured to be placed in a state including one of disabled, and enabled to correct an amount of deviation in data writing position in accordance with a third difficulty level when the information indicates that the type of document is a mixed character and photography document.

11. The optical writing system according to claim 1, wherein said second correction mechanism is further configured to be placed in a state including one of disabled, and enabled to correct an amount of deviation in data writing position in accordance with a fourth difficulty level when the information indicates that the type of document is a non-character and non-photography document.

* * * * *